US006266837B1

(12) United States Patent
Nord

(10) Patent No.: US 6,266,837 B1
(45) Date of Patent: Jul. 31, 2001

(54) COMBINED TWO-SHOE TREE AND ORGANIZER

(76) Inventor: Robert E. Nord, 481 Woodlawn, Glencoe, IL (US) 60022

( * ) Notice: Subject to any disclaimer, the term of this patent is extended or adjusted under 35 U.S.C. 154(b) by 0 days.

(21) Appl. No.: 09/589,365

(22) Filed: Jun. 8, 2000

(51) Int. Cl.[7] ..... A43D 5/00; A43D 15/00; A43D 19/00; A43D 95/00

(52) U.S. Cl. ..... 12/114.2; 12/115.6; 12/116.6; 12/117.4

(58) Field of Search ..... 12/114.2, 114.4, 12/114.6, 114.8, 115.2, 115.4, 115.6, 115.8, 116.2, 116.4, 116.6, 116.8, 117.2, 117.4, 128 R, 133, 136

(56) References Cited

U.S. PATENT DOCUMENTS

| | | | | |
|---|---|---|---|---|
| 1,694,853 | * | 12/1928 | Hess | 12/115.6 |
| 2,262,459 | | 11/1941 | Hoppe . | |
| 2,317,516 | | 4/1943 | Brace . | |
| 2,438,748 | * | 3/1948 | Greenberg | 12/117.4 |
| 2,556,637 | * | 6/1951 | Stewart | 12/115.6 |
| 2,879,527 | * | 3/1959 | Davis | 12/115.8 |
| 3,068,502 | * | 12/1962 | Williams | 12/116.6 |
| 3,254,354 | * | 6/1966 | Lowe | 12/115.8 |
| 3,292,794 | | 12/1966 | Lowe . | |
| 3,501,792 | | 3/1970 | Merriman . | |
| 3,860,986 | * | 1/1975 | Ballard | 12/115.2 |
| 4,094,060 | * | 6/1978 | Saad | 12/116.8 |
| 5,414,975 | * | 5/1995 | Hummel | 12/114.4 |

* cited by examiner

*Primary Examiner*—Paul T. Sewell
*Assistant Examiner*—Anthony Stashick
(74) *Attorney, Agent, or Firm*—Peter A. Borsari

(57) ABSTRACT

A combined shoe tree and organizer comprising a two-shoe tree capable of holding and preserving a pair of shoes and an organizer therefor. The two-shoe tree comprises a mounting portion and two heel members, each heel member being connected to said mounting portion by an expandable stretcher bar and is designed to hold and preserve two (i.e. a pair of) shoes as a single unit. The two-shoe tree is provided with an aperture such that is can be integrated or combined with an organizer having a plurality of post members. In this manner, the shoe tree can be detachably secured to the organizer by mounting said aperture over one of the post members. The organizer may be in the form of a single rod which can retain a plurality of two-shoe trees or may be in the form of multiple rods in a grid frame arrangement to form a rack. The organizer can have either a horizontal orientation, for placement on a flat surface, or a vertical orientation for hanging from a door or mounting to a wall.

20 Claims, 5 Drawing Sheets

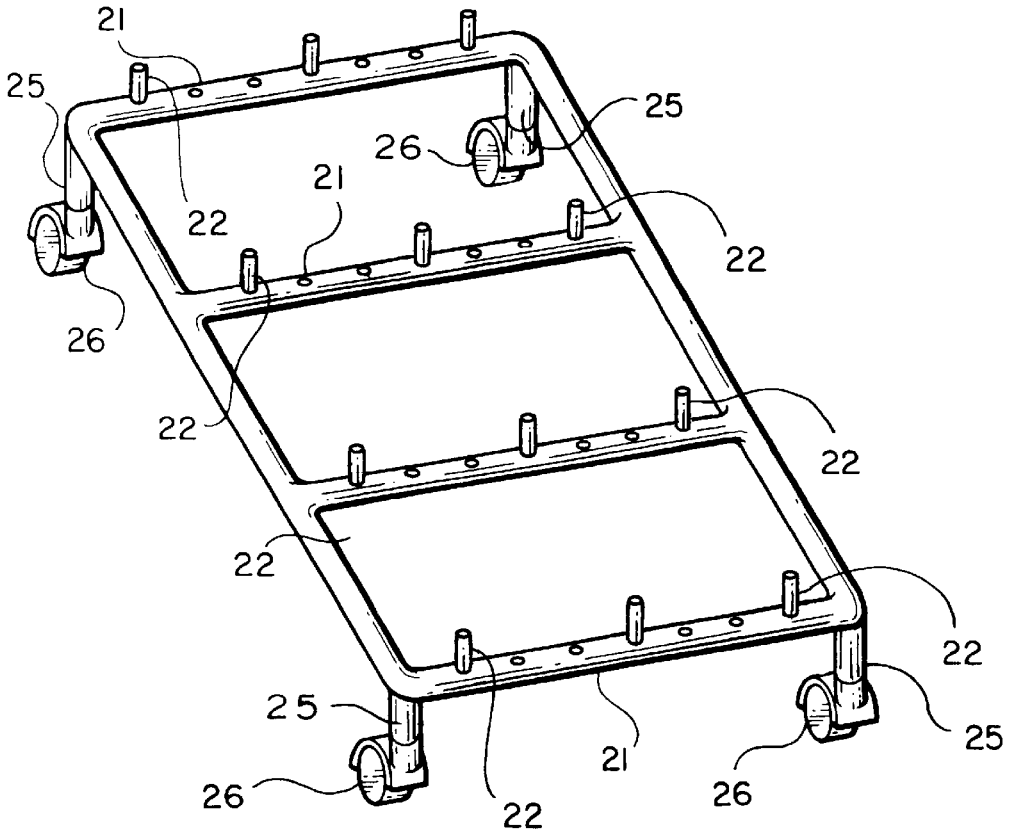
FIG. 6
FIG. 4
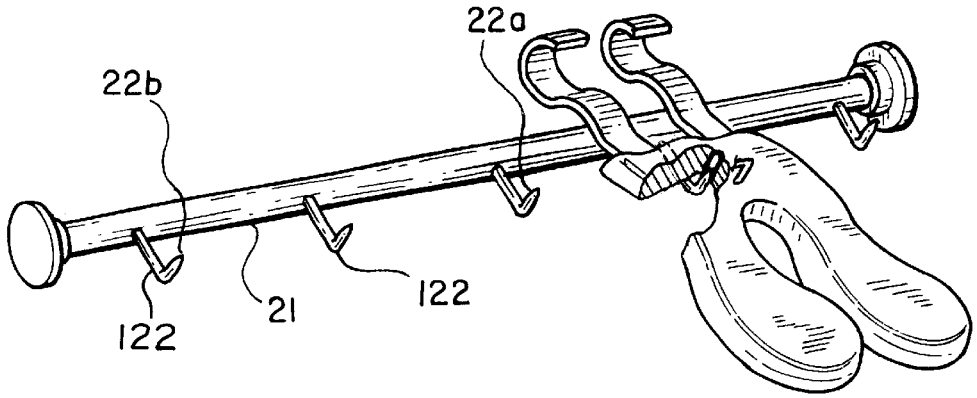

COMBINED TWO-SHOE TREE AND ORGANIZER

FIELD OF INVENTION

The present invention relates to a shoe tree capable of holding and preserving a pair of shoes and an organizer therefor. More particularly, the present invention relates to a single shoe tree which has been designed to hold and preserve a pair (i.e. two) of shoes and which is combined with an organizer such that the shoe tree can be detachably secured to the organizer. The organizer may be in the form of a single rod which can retain a plurality of two-shoe trees or may be in the form of grid frame rack comprising multiple rods. The organizer can have either a horizontal orientation, for placement on a flat surface or for mounting on a wall, such as above a closet rod, or a vertical orientation for hanging from a door, mounting to a wall or in the form of a pole, such as a floor to ceiling arrangement.

BACKGROUND OF THE INVENTION

The use of a shoe tree, to stretch and preserve the integrity of a shoe is quite well known. Attempts have been made to incorporate the shoe tree with a shoe rack, particularly for display purposes. For example, U.S. Pat. No. 3,292,794 to Lowe issued Dec. 20, 1966, discloses a shoe rack having a base, a shoe tree mounting bar connected to the base and a plurality of shoe trees fixedly connected to the mounting member by the heel portions of each of the shoe trees. Each shoe tree is capable of retaining only one shoe. The mounting arrangement in Lowe is fairly complicated and primarily used for display purposes. As a result, the shoe trees cannot be removed quickly and easily. Similarly, U.S. Pat. No. 2,317,516 to Brace, issued Apr. 27, 1943 shows a shoe-tree holder in which a pair of one-shoe retaining shoe trees are arranged in paired relationship on a support plate. Another example of a combination shoe tree and rack arrangement is provided in U.S. Pat. No. 2,262,459 to Hoppe, issued Nov. 11, 1941 which discloses a plurality of one-shoe retaining shoe trees, each riveted to a support bar and the support bar being mounted to a wall. U.S. Pat. No. 3,501,792 to Merriman, issued Mar. 24, 1970, teaches a wire shoe tree having an extended handle or hook portion by which the shoe tree may be hung or interconnected with other such shoe trees and then suspended above the floor.

In view of the prior art, a need still exists to provide a shoe tree capable of holding and preserving two (i.e. a pair of) shoes and which can be combined with an organizer for maintaining a plurality of shoe trees. Such a device should enable a user to quickly and easily attach each of a pair of shoes to the device and thereafter handle the pair as a single element. Further, such a device should be capable of mounting to an organizer in a simple manner and should facilitate the storage of a plurality of shoe trees on an organizer in a minimum amount of space. In addition, such a device should be of few parts and be inexpensive to manufacture.

SUMMARY OF THE INVENTION

Accordingly, it is an object of the present invention to provide a two-shoe tree which can hold and preserve two (i.e. a pair of) shoes.

It is an additional object of the present invention to provide a two-shoe tree wherein two (i.e. a pair of) shoes can be handled and carried as a single unit.

It is another object of the present invention to provide a combined two-shoe tree and organizer, wherein a plurality of two-shoe trees can be detachably secured to the organizer.

It is an additional object of the present invention to provide a combined two-shoe tree and organizer, wherein the organizer has a vertical orientation such that it can be mounted to a wall, hung from a door or in the form of a pole, such as a floor to ceiling arrangement.

It is a further object of the present invention to provide a combined two-shoe tree and organizer, wherein the organizer has a horizontal orientation such that it can be placed on a flat surface or mounted to a wall.

It is still a further object of the present invention to provide a combined two-shoe tree and organizer having a horizontal orientation and fitted with caster wheels such that it can be rolled along a flat surface and under a bed.

It is yet another object of the present invention to provide a combined two-shoe tree and organizer which allows a user to quickly and easily attach each of a pair of shoes to the shoe tree and thereafter handle the pair as a single element.

It is an additional object of the present invention to provide a combined two-shoe tree and organizer, wherein the shoe tree can be quickly and easily detachably secured to the organizer.

It is a further object of the present invention to provide a combined two-shoe tree and organizer which facilitates the storage of a plurality of shoe trees on an organizer in a minimum amount of space.

It also is an object of the present invention to provide a combined two-shoe tree and organizer which comprises few parts and which is inexpensive to manufacture.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein:

FIG. 4 is a front perspective view of the two-shoe tree and organizer of the present invention, wherein the organizer has a horizontal orientation and is in the form of a single rod for mounting between two walls.

FIG. 6 is a front perspective view of the two-shoe tree and organizer of the present invention, wherein the organizer has a horizontal orientation and is in the form of a rack comprising multiple rods and is provided with caster wheels.

DETAILED DESCRIPTION

The present invention relates to a shoe tree capable of holding and preserving two shoes, typically a pair of shoes (hereinafter referred to as a "two-shoe tree") and which is combined with an organizer such that the two-shoe tree can be detachably secured to the organizer. The organizer is provided with multiple attachment means, such that a plurality of two-shoe trees can be detachably secured thereto.

Figure 1:
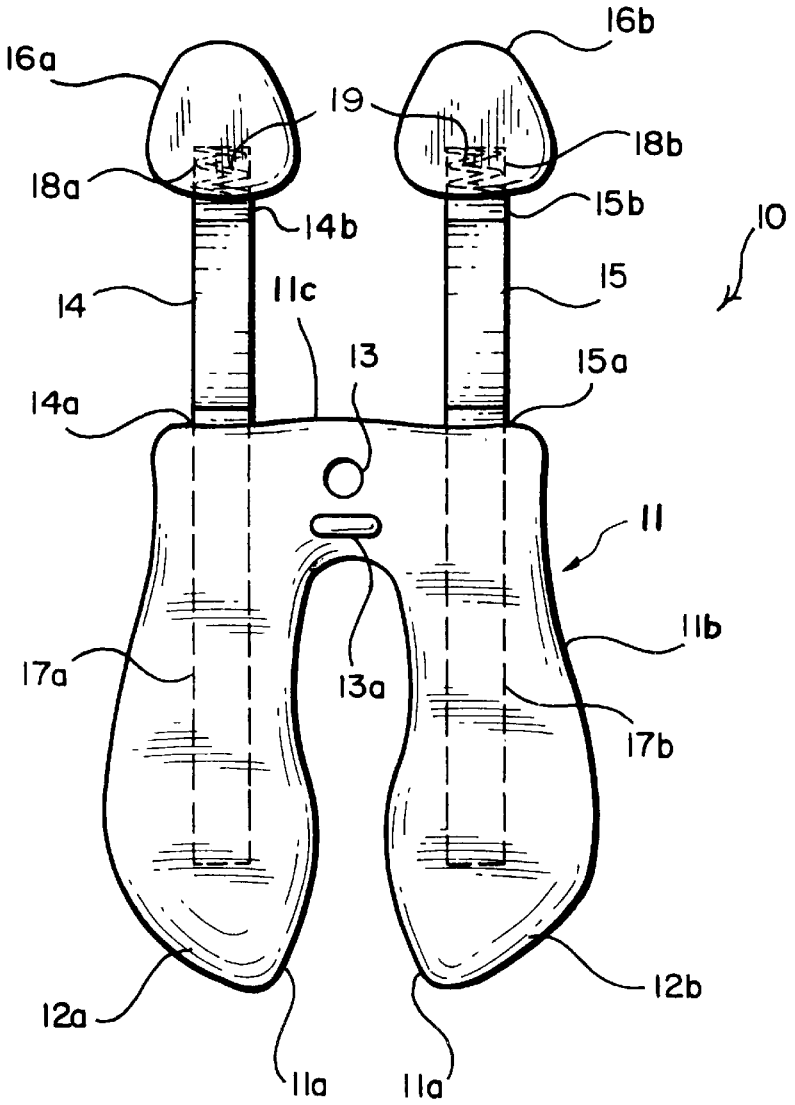
FIG. 1 is a top view of the two-shoe tree of the present invention.

As shown in FIG. 1, the two-shoe tree 10 of the present invention comprises a mounting portion 11 having a toe end 11*a* constructed with two frontal lobes 12*a* and 12*b* each designed to maintain the shape of the toe end of a shoe (hereinafter referred to as toe member 12*a* and toe member 12*b*), a mid-section 11*b* and a mounting end 11*c*, an aperture 13 centrally disposed near said mounting end 11*c*, a first expandable stretcher bar 14, a second expandable stretcher bar 15, and first and second heel members 16*a* and 16*b*. First expandable stretcher bar 14 comprises a first end 14*a* rigidly affixed to said mid-section 11*b* and a second end 14*b* secured to said first heel member 16*a*. Second expandable stretcher bar 15 comprises a first end 15*a* also rigidly affixed to said mid-section 11*b* and a second end 15*b* secured to said second heel member 16*b*. Mounting portion 11 and heel members 16*a* and 16*b* can be constructed from a variety of materials, including for example, wood, plastic, fiberglass, nylon-reinforced fiberglass, light-weight metal, plastic-coated metal and the like.

Figure 2:
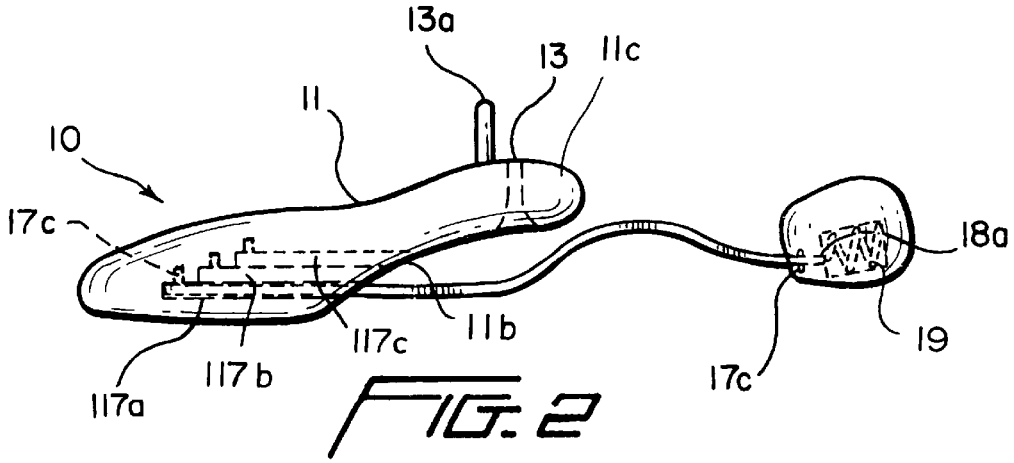
FIG. 2 is a side perspective view of the two-shoe tree of the present invention.

Expandable stretcher bars 14 and 15 can be affixed to the mid-section 11*b* by any securing means which provides a secure attachment. Suitable securing means include, for example, bolting or adhering each of said first ends 14*a* and 15*a* to said mid-section 11*b*. In another suitable securing means, the mid-section 11*b* can be provided with two longitudinal grooves 17*a* and 17*b* sized to correspond to the outer configuration of the first and second ends 14*a* and 15*a* such that each groove slidably receives one of the first and second ends as shown in FIGS. 1 and 2. The expandable stretcher bars can be held and retained within the grooves by a pin 17*c* or the like. In an alternative embodiment, multiple longitudinal grooves 117*a* and 117*b* may be provided within the mid-section 11*b*, in a staggered configuration, as shown in FIG. 2, thereby enabling adjustment to shoes of different sizes. In another alternative embodiment, each of said longitudinal grooves may be internally threaded and each of said first ends 14*a* and 15*a* may be externally threaded such that each of said first ends may be threadingly secured to said mid-section 11*b*. However, it is to be understood that these securing means merely are illustrative and that other securing means capable of rigidly affixing said first ends 14*a* and 15*a* to said midsection 11*b* are contemplated to be within the scope of this invention.

Figure 3:
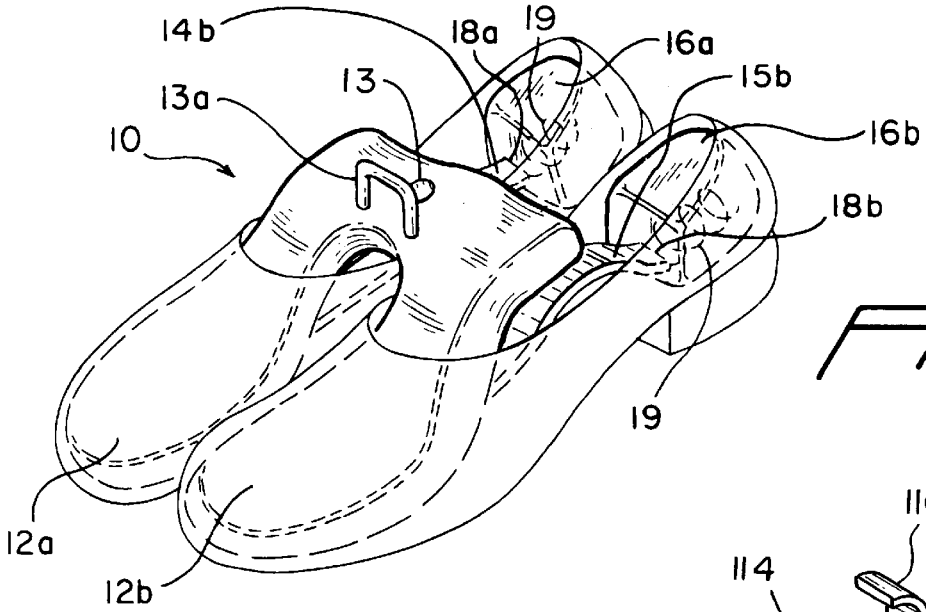
FIG. 3 is a front perspective view of the two-shoe tree of the present invention showing a pair of shoes thereon.

Each of said heel members 16*a* and 16*b* is provided with a longitudinal bore, 18*a* and 18*b* respectively, which is configured to slidably receive and retain one of said second ends 14*b* and 15*b* of said first and second expandable stretcher bars 14 and 15. Each of said second ends 14*b* and 15*b* is provided with a spring element 19, for example a coil spring or tension spring, which acts against the distal end of the longitudinal bore in such a manner that the heel member is forced away from the mounting portion 11. In this manner, the spring functions to urge each toe member 12*a* and 12*b* away from the respective heel member 16*a* and 16*b*. Thus, when the toe end of a shoe is placed on toe member 12*a* of said two-shoe tree 10, for example, the spring element 19 presses the heel member 16*a* and is compressed against the heel end of the shoe, thereby longitudinally stretching and preserving the shoe as shown in FIG. 3. Once both of a pair of shoes are placed on the two-shoe tree, the user is able to handle the pair of shoes as a single element. To facilitate handling and carrying the two-shoe tree, a gripping means 13*a*, including for example a tab element or a loop member, can be disposed near said aperture 13 as shown in FIG. 1.

Figure 3A:
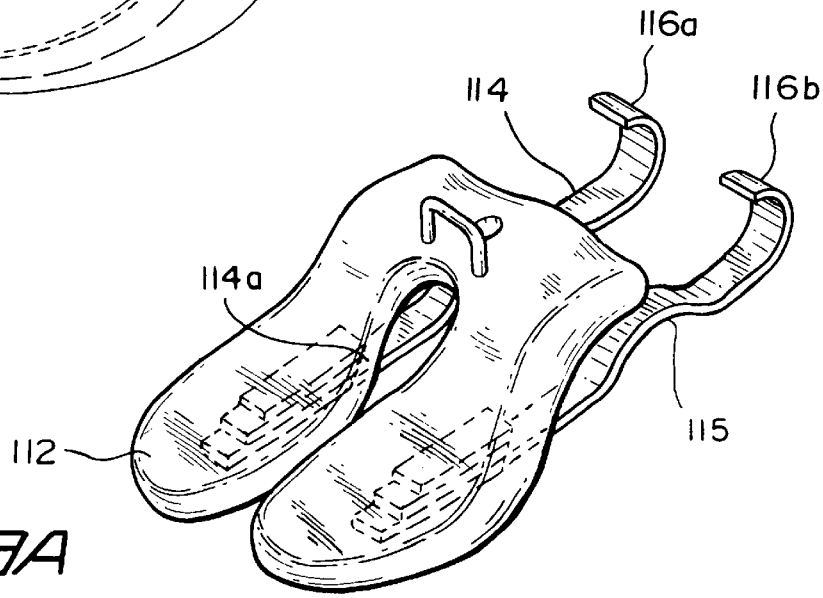
FIG. 3A is a front perspective view of a first alternative embodiment of the stretcher bar and heel member of the present invention.

In an alternative embodiment, the heel member is incorporated into the stretcher bar. Referring to FIG. 3A, stretcher bar 114 terminates into heel member 116*a* and stretcher bar 115 terminates into heel member 116*b*. In this embodiment, no spring element is provided. Rather, adjustability for accommodating different shoe sizes can be achieved by utilizing the staggered multiple longitudinal grooves 117 as shown in FIG. 2. Optionally, a leaf spring mechanism 119 can be provided at end 114*a* to engage the longitudinal grooves, thereby pushing the heel member 116*a* away from the toe end 112.

Figure 3B:
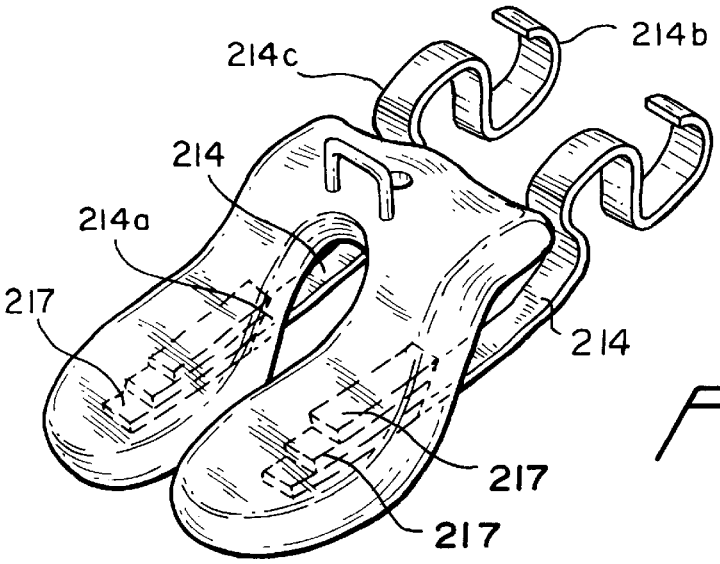
FIG. 3B is a front perspective view of a second alternative embodiment of the stretcher bar and heel member of the present invention.

In another alternative embodiment, each expandable stretcher bar is in the form of a serpentine spring terminating into a heel engaging end. Referring to FIG. 3B, expandable stretcher bar 214 comprises a first end 214*a* which is configured to engage longitudinal groove 217, a midsection 214*c* having a serpentine configuration, thereby providing the stretcher bar 214 with spring-like capability, and a heel engaging end 214*b*.

Figure 5:
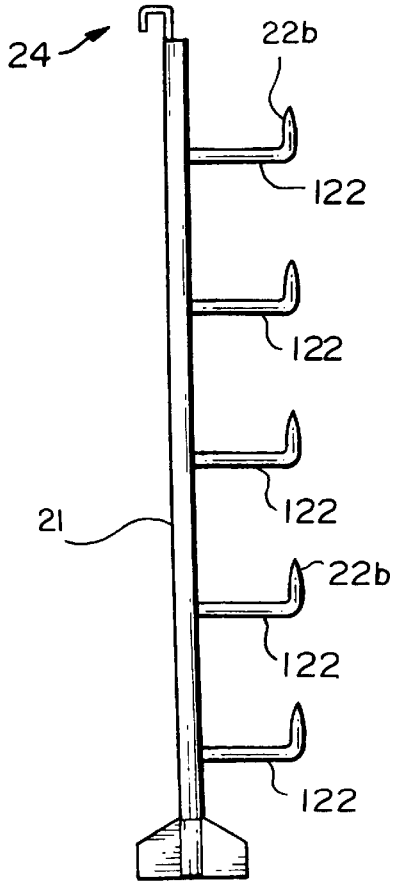
FIG. 5 is a side perspective view of the two-shoe tree and organizer of the present invention, wherein the organizer has a vertical orientation and is in the form of a single rod for mounting to a wall, hanging from a door or closet rod, or in the form of a pole, such as a floor to ceiling arrangement.

The two-shoe tree 10 of the present invention is combined with an organizer 20. Referring to FIGS. 4 and 5, the organizer 20 is in the form of a single rod 21 having a plurality of spaced apart post members 22 thereon. Each post member 22 is dimensioned in such a manner that it can engage aperture 13 of the two-shoe tree 10. Although shown as a round circle in the Figures, it is to be understood that aperture 13 can be of any desired shape, such as oval, elliptical, square or rectangular, provided that said post member 22 can be dimensioned to engage the aperture. In this manner, aperture 13 can be mounted over said post member 22, thereby detachably securing said two-shoe tree to said organizer. Post member 22 can be straight element disposed at a 90° angle from said rod 21, or can be formed with a hooked end 22*a*, such as in the form of an "L" or "J", as shown in the Figures. The organizer 20 of the present invention can have a horizontal or vertical orientation. As shown in FIG. 4, the organizer 20 has a horizontal orientation, capable of being mounted to a wall or between two walls, such as closet rod. In FIG. 5, the organizer 20 has a vertical orientation, capable of being mounted to a wall or between the ceiling and floor.

Figure 7:
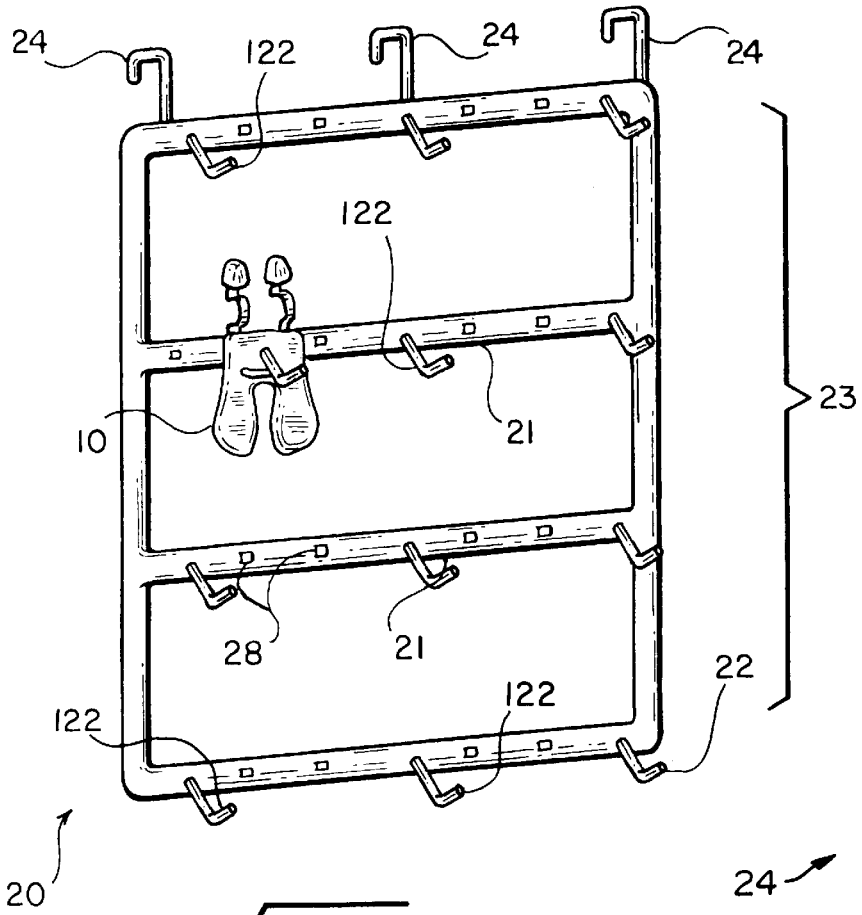
FIG. 7 is a front perspective view of the two-shoe tree and organizer of the present invention, wherein the organizer has a vertical orientation and is in the form of a rack comprising multiple rods for mounting to a wall or hanging from a door.

The organizer may comprise a single rod 21 as discussed above, or may comprise multiple rods 21 in the form of a rack or grid frame 23, as shown in FIGS. 6 and 7, each rod 21 of the rack 23 being sufficiently spaced apart from one another such that a plurality of two-shoe trees may be detachably secured thereto. Referring specifically to FIG. 6, the organizer 20 of the present invention may be disposed in a horizontal orientation and be provided with leg elements 25 such that the organizer can be placed on a flat surface. Preferably, each leg element 25 is provided with a caster wheel 26 so that the organizer 20 can be rolled under a bed for storage. As shown in FIG. 7, the organizer 20 of the present invention may be disposed in a vertical orientation suitable for mounting to a wall, or may be provided with one or more hook elements 24 such that the organizer can be hung from a door or a closet clothes rod.

Figure 8:
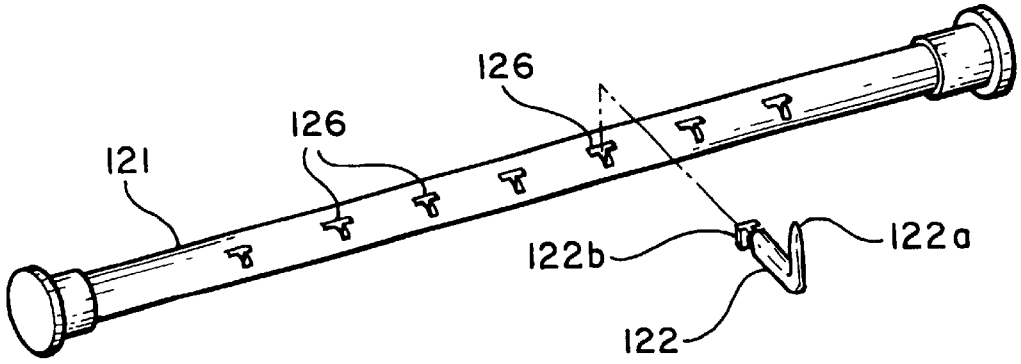
FIG. 8 is a front perspective view of an alternative embodiment of the present invention, wherein the organizer is provided with adjustable post members.

In the embodiments discussed above, the post members 22 are either integrally molded with the rod 21 or are permanently affixed thereto by means well known in the art. Alternatively, the post members may be adjustably secured to the rod. Referring to FIG. 8, rod 121 is configured with a series of slots 126 along its length. A plurality of post members 122 are provided, each having a first end 122*a* and a second end 122*b* which engages slot 126. Alternatively, the post members 122 can be detachably secured to the rod 121 by a simple snap-fit arrangement. In this manner, the user can adjust the distance between each post member to accommodate shoes of different sizes.

Figure 9:
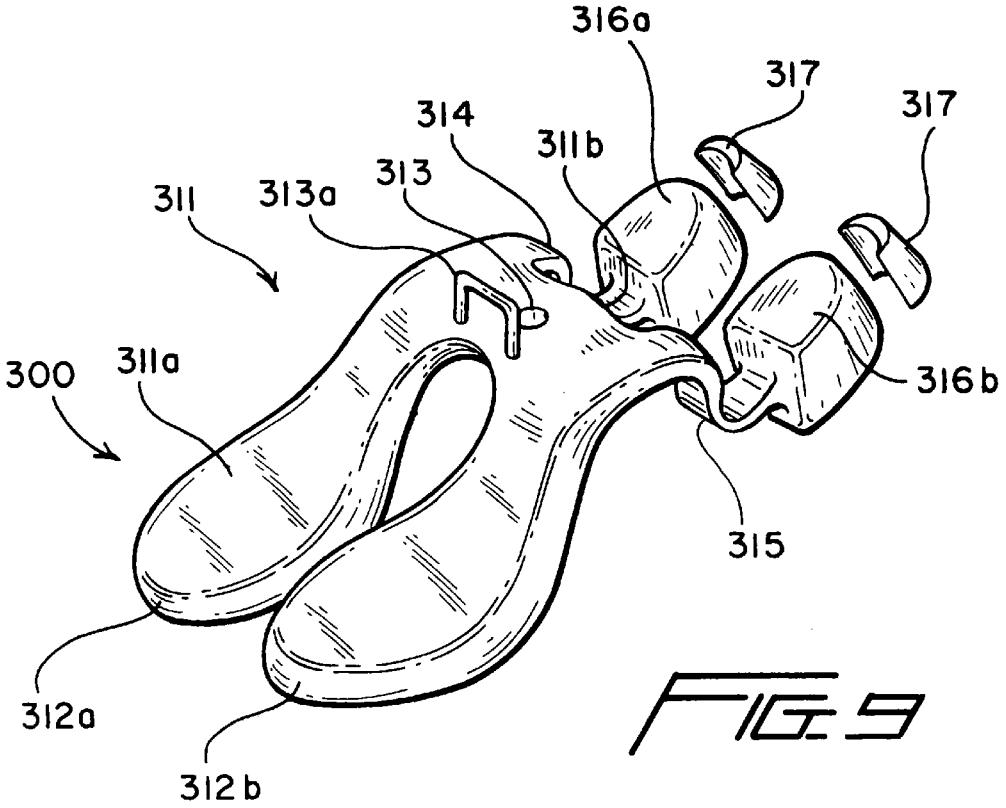
FIG. 9 is a front perspective view of an alternative embodiment of the present invention, wherein the two-shoe tree is of a unitary construction.

In another alternative embodiment, the two-shoe tree is formed as a single, unitary unit. As shown in FIG. 9, the two-shoe tree 300 comprises a mounting portion 311 having a toe end 311*a* constructed with two frontal lobes 312*a* and 312*b* each designed to maintain the shape of the toe end of a shoe, a mid-section 311*b* and a mounting end 311*c*, an aperture 313 centrally disposed near said mounting end 311*c*, a gripping means 313*a*, a first elongated bar 314 terminating into a first heel member 316*a* and a second elongated bar 315 terminating into second heel members 316*b*. The unitary two-shoe tree 311 can be constructed from a variety of materials, including for example, wood, plastic, fiberglass, nylon-reinforced fiberglass, light-weight metal, plastic-coated metal and the like. Insofar as the unitary two-shoe tree 311 is not adjustable to accommodate different shoe sizes, a plurality of heel elements 317 are provided which can be placed within the heel portion of a shoe.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A combined two-shoe tree and organizer comprising:

(a) a two shoe tree comprising a mounting portion having a toe end, a mid-section and a mounting end, said toe end having two toe members;

an aperture centrally disposed within said mounting end;

a first heel member and a second heel member;

a first expandable stretcher bar having a first end secured to said mid-section of said mounting portion, and a second end having a spring element and attached to said first heel member, and a second expandable stretcher bar having a first end secured to said mid-section end of said mounting portion, and a second end having a spring element and attached to said second heel member; and (b) an organizer comprising at least one rod having a plurality of post members thereon, each of said plurality of post members being configured in such a manner that said two-shoe tree can be detachably secured to said organizer by mounting said aperture of said two-shoe tree over one of said plurality of post members.

2. The combined two-shoe tree and organizer in accordance with claim 1, wherein said organizer comprises a single rod which can be disposed in a vertical orientation for securing to a vertical surface.

3. The combined two-shoe tree and organizer in accordance with claim 1, wherein said organizer comprises a single rod which can be disposed in a vertical orientation for mounting between a floor and a ceiling.

4. The combined two-shoe tree and organizer in accordance with claim 1, wherein said organizer comprises a single rod which can be disposed in a horizontal orientation for mounting between to walls.

5. The combined two-shoe tree and organizer in accordance with claim 1, wherein said at least one rod is a plurality of rods arranged in a grid frame to form a rack.

6. The combined two-shoe tree and organizer in accordance with claim 5, wherein said organizer further comprises four leg members.

7. The combined two-shoe tree and organizer in accordance with claim 6, wherein each of said four leg members is provided with a caster wheel.

8. The combined two-shoe tree and organizer in accordance with claim 5, wherein said organizer comprises means to be secured to a vertical surface.

9. The combined two-shoe tree and organizer in accordance with claim 5, wherein said organizer further comprises at least one hook element, said at least one hook element enabling said organizer to be hung.

10. The combined two-shoe tree and organizer in accordance with claim 1, wherein said mounting portion is constructed from a single piece of material.

11. The combined two-shoe tree and organizer in accordance with claim 10, wherein said single piece of material is selected from the group consisting of wood, plastic, fiberglass, nylon-reinforced fiberglass, light-weight metal and plastic-coated metal.

12. The combined two-shoe tree and organizer in accordance with claim 1, wherein said first heel member is incorporated into said first stretcher bar and said second heel member is incorporated into said second stretcher bar.

13. The combined two-shoe tree and organizer in accordance with claim 1, wherein said second end of said first stretcher bar is in the form of a serpentine spring terminating into a first heel member and said second end of said second stretcher bar is in the form of a serpentine spring terminating into a second heel member.

14. The combined two-shoe tree and organizer in accordance with claim 1, wherein said mid-section is provided with at least one first longitudinal groove within which said first end of said first stretcher bar is slidably secured an at least one second longitudinal groove within which said first end of said second stretcher bar is slidably secured.

15. The combined two-shoe tree and organizer in accordance with claim 14, wherein said at least one first longitudinal groove comprises a plurality of longitudinal grooves of differing lengths and said at least one second longitudinal groove comprises a plurality of longitudinal grooves of differing lengths.

16. The combined two-shoe tree and organizer in accordance with claim 1, further comprising gripping means disposed on said mounting end.

17. A two-shoe tree comprising:

(a) a mounting portion having a toe end, a mid-section and a mounting end, said toe end having two toe members;

(b) an aperture centrally disposed within said mounting end;

(c) a first heel member and a second heel member;

(d) a first expandable stretcher bar having a first end secured to said mid-section of said mounting portion, and a second end having a spring element and attached to said first heel member, and (e) a second expandable stretcher bar having a first end secured to said mid-section of said mounting portion, and a second end having a spring element and attached to said second heel member.

18. A two-shoe tree in accordance with claim 17, wherein said aperture is of sufficient size that said two-shoe tree can be hung from a post.

19. A two-shoe tree of unitary construction comprising a mounting portion having a toe end having two toe members, a mid-section and a mounting end, a first elongated bar extending from said mid-section and terminating into a first heel member and a second elongated bar extending from said mid-section and terminating into a second heel member.

20. A two-shoe tree of unitary construction in accordance with claim 19 in combination with a organizer in the form of at least one rod having a plurality of post members thereon, said two-shoe tree further comprising an aperture disposed within said mounting end for engaging one of said plurality of post members.

* * * * *